US007848933B2

(12) United States Patent
Michener

(10) Patent No.: US 7,848,933 B2
(45) Date of Patent: Dec. 7, 2010

(54) ERROR MONITORING OF A DOLBY DIGITAL AC-3 BIT STREAM

(75) Inventor: James A. Michener, Grass Valley, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 452 days.

(21) Appl. No.: 11/854,453

(22) Filed: Sep. 12, 2007

(65) Prior Publication Data

US 2008/0004735 A1 Jan. 3, 2008

Related U.S. Application Data

(62) Division of application No. 09/345,659, filed on Jun. 30, 1999, now Pat. No. 7,283,965.

(51) Int. Cl.
*G10L 19/00* (2006.01)

(52) U.S. Cl. ..... 704/500

(58) Field of Classification Search ..... 704/500–504; 348/423, 461, 462, 464; 455/6.3
See application file for complete search history.

(56) References Cited

U.S. PATENT DOCUMENTS 5,091,936 A 2/1992 Katznelson et al.
5,712,850 A 1/1998 Elia et al.
5,812,976 A 9/1998 Ryan
5,819,004 A * 10/1998 Azadegan et al. ..... 386/112
5,835,493 A 11/1998 Magee et al.
5,838,874 A * 11/1998 Ng et al. ..... 386/96
5,845,249 A 12/1998 Malladi et al.
5,903,872 A * 5/1999 Fielder ..... 704/500
5,913,190 A * 6/1999 Fielder et al. ..... 704/229
5,915,066 A 6/1999 Katayama
5,917,836 A 6/1999 Ichikawa et al.
5,956,674 A 9/1999 Smyth et al.
5,974,380 A 10/1999 Smyth et al.

(Continued)

OTHER PUBLICATIONS

Johnston; "MPEG-Audio Draft, Description as of Dec. 10, 1990"; pp. 336-337; 1991 IEEE.

(Continued)

*Primary Examiner*—Michael N Opsasnick

(57) ABSTRACT

Methods and apparatus for broadcasting high quality audio "studio direct" with the same digital information employed in the studio by the video producer with AC-3 digital audio signals for broadcast to integrated receiver decoders (IRD). Control over individual data bits such as copyright bits is maintained by determining the bit status, comparing it to a preferred status, changing the status if it does not comply with the preferred status, and reevaluating cyclical redundancy check value in each data packet to avoid disruption in the data transmission. The system includes an uplink device which automatically checks, logs and reports errors in Dolby Digital AC-3 signals by a monitor which employs a processor, a digital audio card and an SMPTE timecode reader. The monitor employs a state machine that finds AC-3 packets, locks into the packets and detects discontinuities or loss of signal. A sound card having an input for receiving house reference AES clock pulses enables the AES clock of the playback signal to be locked to the frequency of a production house master as a time code reader or an editor's contact closure match video and audio signals playback.

11 Claims, 4 Drawing Sheets

U.S. PATENT DOCUMENTS

| | | | | |
|---|---|---|---|---|
| 6,002,687 | A | 12/1999 | Magee et al. | |
| 6,009,389 | A | 12/1999 | Dokic et al. | |
| 6,026,232 | A * | 2/2000 | Yogeshwar et al. | 715/719 |
| 6,029,126 | A | 2/2000 | Malvar | |
| 6,041,295 | A | 3/2000 | Hinderks | |
| 6,061,387 | A | 5/2000 | Yi | |
| 6,064,676 | A * | 5/2000 | Slattery et al. | 370/412 |
| 6,108,584 | A | 8/2000 | Edwards | |
| 6,111,896 | A * | 8/2000 | Slattery et al. | 370/535 |
| 6,208,802 | B1 | 3/2001 | Mori et al. | |
| 6,212,199 | B1 * | 4/2001 | Oxford | 370/466 |
| 6,226,608 | B1 * | 5/2001 | Fielder et al. | 704/229 |
| 6,226,616 | B1 | 5/2001 | You et al. | |
| 6,226,758 | B1 | 5/2001 | Gaalaas et al. | |
| 6,253,293 | B1 | 6/2001 | Rao et al. | |
| 6,266,329 | B1 | 7/2001 | Lazaris-Brunner et al. | |
| 6,278,717 | B1 | 8/2001 | Arsenault et al. | |
| 6,311,161 | B1 | 10/2001 | Anderson et al. | |
| 6,317,885 | B1 | 11/2001 | Fries | |
| 6,332,119 | B1 | 12/2001 | Hinderks | |
| 6,341,375 | B1 | 1/2002 | Watkins | |
| 6,356,871 | B1 * | 3/2002 | Hemkumar et al. | 704/500 |
| 6,357,029 | B1 | 3/2002 | Sinha et al. | |
| 6,360,368 | B1 | 3/2002 | Chawla | |
| 6,366,761 | B1 | 4/2002 | Montpetit | |
| 6,446,037 | B1 * | 9/2002 | Fielder et al. | 704/229 |
| 6,487,535 | B1 * | 11/2002 | Smyth et al. | 704/500 |
| 6,498,922 | B1 | 12/2002 | Lazaris-Brunner et al. | |
| 6,522,767 | B1 * | 2/2003 | Moskowitz et al. | 382/100 |
| 6,542,518 | B1 | 4/2003 | Miyazawa | |
| 6,549,241 | B2 | 4/2003 | Hiroi | |
| 6,560,496 | B1 | 5/2003 | Michener | |
| 6,584,153 | B1 | 6/2003 | Comito et al. | |
| 6,584,278 | B2 | 6/2003 | Ando et al. | |
| 6,611,537 | B1 * | 8/2003 | Edens et al. | 370/503 |

OTHER PUBLICATIONS

Angelici et al.; "New Architecture for an AES-EBU Digital Audio Receiver"; pp. 694-698; IEEE, 1997.

Li et al.; "An AC-3/MPEG Multi-Standard Audio Decoder IC"; May 8, 1997; Custom Integrated Circuits Conference; 1997; Proceedings of the IEEE 1997; pp. 245-248.

Bergher et al.; "Dolby AC-3 and MPEG-2 Audio Decoder IC with 6 Channel Output"; Consumer Electronics, IEEE Transactions; vol. 43, Issue 3; Aug. 1997; pp. 567-574.

Tsai et al.; "An MPEG Audio Decoder Chip"; Consumer Electronics, IEEE Transactions; vol. 41, Issue 1; Feb. 1995; pp. 89-96.

Biere, D.; "A Flexible and Modular Approach for Transmission of Digital TV and for Interactive Services Broadcasting Convention"; 1995; IBC '95 International; Sep. 14-18, 1995; pp. 195-201.

Lau, W.; Chwu, A.; "A Common Transform Engine for MPEG and AC3 Audio Decoder"; Consumer Electronics, IEEE Transactions; vol. 43, Issue 3; Aug. 1997; pp. 559-566.

* cited by examiner

Fig. 5
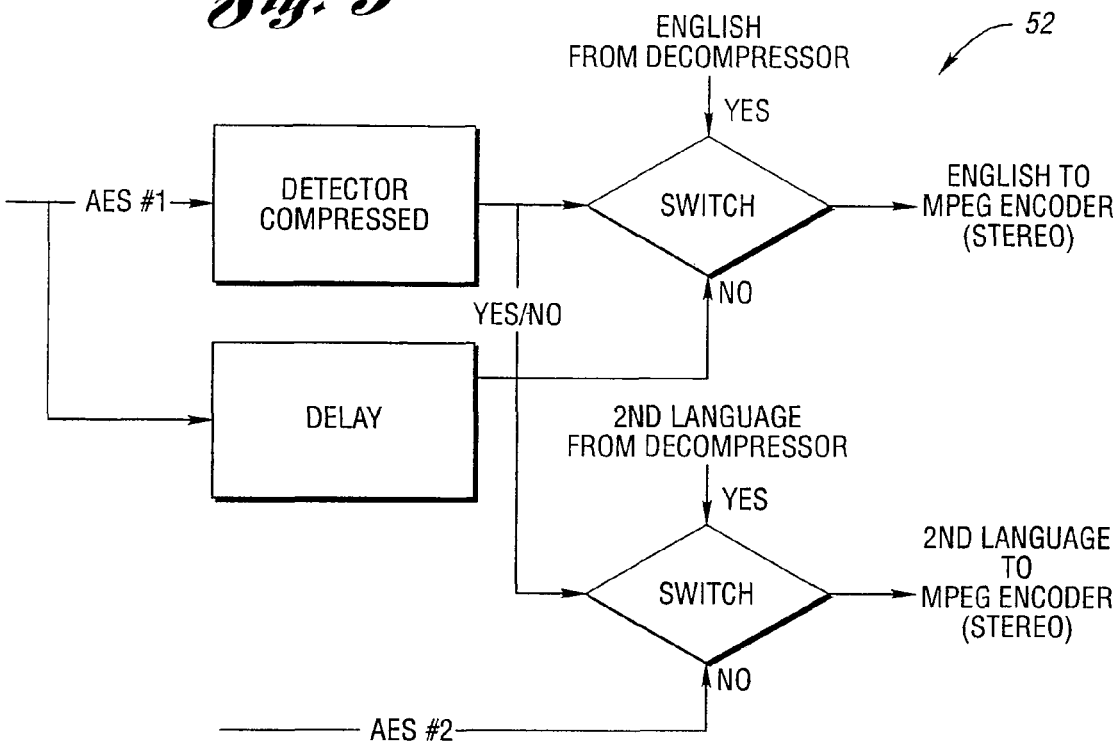
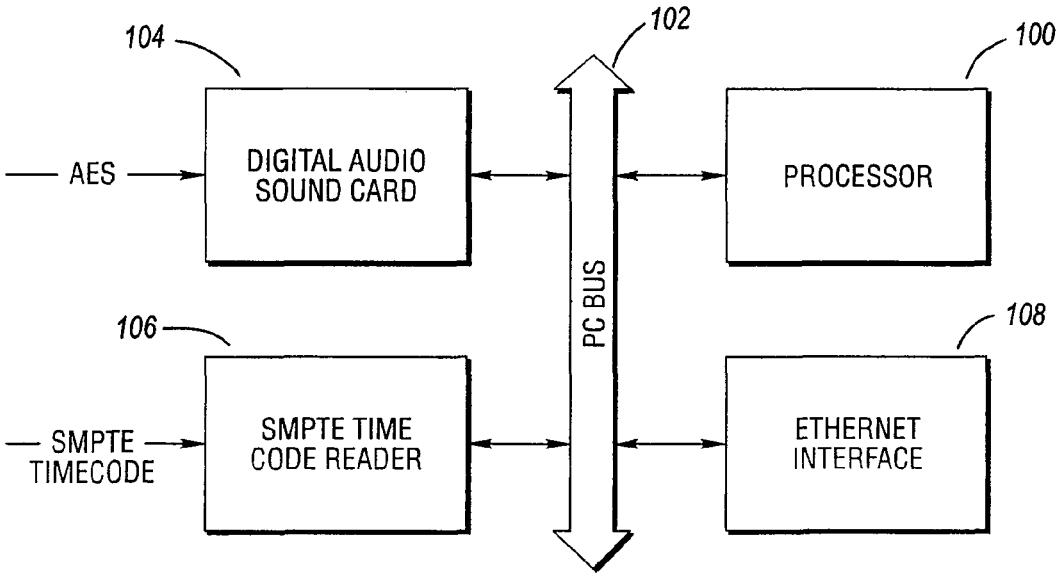
Fig. 6

ERROR MONITORING OF A DOLBY DIGITAL AC-3 BIT STREAM

CROSS-REFERENCE TO RELATED APPLICATIONS

This application is a divisional and claims the benefit under 35 U.S.C. Section 120 of the following co-pending and commonly-assigned U.S. utility patent application, which is incorporated by reference herein:

U.S. patent application Ser. No. 09/345,659, entitled "DELIVERY AND TRANSMISSION OF DOLBY DIGITAL AC-3 OVER TELEVISION BROADCAST", by James A. Michener, filed on Jun. 30, 1999.

TECHNICAL FIELD

The present invention relates to apparatus and methods for transmitting video and motion picture broadcasts with AC-3 audio compression systems accepted by the Advance Television Systems Committee (ATSC) for the new American terrestrial broadcast digital television standard with direct from the studio multi-channel audio capability.

BACKGROUND ART

In 1994, AC-3 marketed as Dolby Digital® was accepted by the ATSC as the audio compression system for the new American terrestrial broadcast digital television standard. At that time, DIRECTV® was already delivering digital transmission to the United States via satellite. For audio compression, DIRECTV® was broadcasting using "MPEG level 1" audio compression providing stereo audio. Dolby Digital® AC-3 won the ATSC selection committee by providing for slightly better compression as well as means of handling a wide array of programming modes up to "5.1 channel". 5.1 channels of surround sound provides for five distinct full fidelity channels, representing: right front, center front, left front, right rear and left rear channels, plus one limited bandwidth "Low Frequency Enhancement" channel. This selection of channels matches what has been available for presentation at movie theaters. The technical details for Dolby Digital® AC-3 is well described as part of the ATSC standard in the ATSC document A/52. This document, as well as the entire ATSC specifications, is available on the World Wide Web at www.atsc.org.

A satellite broadcaster provides multiple channels of recently released movies available for viewing on a Pay-Per-View (PPV) basis. This service competes with the VHS tape rentals market and companies. A competitive edge may be provided by the combination of convenience and quality.

Dolby Digital® with 5.1 channels surround sound has come available on DVD releases. Tape marketers would have a quality advantage for the home theater segment of this market unless technology could be developed to permit broadcasters to transmit such audio features. In the fall of 1997, DIRECTV® undertook the project to broadcast full 5.1 channels of audio into the homes of their customers. On Jul. 1, 1998 DIRECTV® began regular commercial broadcast of Dolby Digital 5.1 channel surround sound, begin the first broadcaster to provide such a service.

The prior practice for handling audio within a broadcast environment is as follows: Audio starts at the source as either analog audio, or digital audio in a generally uncompressed format. The audio is mixed to a final "release" version and then possibly lightly compressed for delivery to the broadcast facility. At that broadcast facility, the audio would again be brought down to an uncompressed format and at the last step in the broadcast chain be fed to a real time audio compression. This compression step would do the final "heavy" lossy audio compression for transmissions to the integrated receiver decoders (IRD) used by the end customers.

In this project DIRECTV® was first to bring Dolby Digital® that was encoded at the movie studio by broadcasting that audio "studio direct" to the customer. This required the development of specific applications in the art to meet this objective. These developments are not obvious from the existing AC-3 technology itself, and many obstacles had to be overcome to develop "studio direct" broadcasting of this multiple channel audio standard. Specifically, Dolby Digital® contains what is called as "meta data", that being ancillary data that is used to control the decoder process. This "meta data" routinely changes on a scene by scene basis, depending on plot of the movie. Examples of "meta data" present in a Dolby Digital® data stream are discussed below.

An LFE is a bit which enables the low frequency enhancement channel. Much of the time this is turned off, providing extra bandwidth availability for the main audio channels. It is enabled where the director wishes to "shake the house". A Dialogue Normalization is a value that defines the dynamic range of the audio with respect to the normal dialog level. Mix Level is an information quantity regarding how to mix a 5.1 channel presentation down to a stereo mix. A Surround Sound Mix Level is a control for the down mix (that reduces the number of channels finally output) levels of the surround sound channels for reproduction as stereo or Dolby Pro-Logic outputs. A Compression gain meta tag controls the decoder dynamic range when the end customer selects a mode of operation that provides a narrow dynamic range.

To do a proper job of encoding Dolby Digital® AC-3, all the above meta data must be supplied correctly by someone knowledgeable of the content. The person most qualified to do provide this information is the sound engineer responsible for mixing the movie at the studio. The ability to deliver to the end customer exactly the same compressed data as created by the sound engineer is a very desirable feature, but not readily available for AC-3 multiple channel audio with the previous broadcast technology.

DISCLOSURE OF INVENTION

The present invention overcomes the above-mentioned disadvantages by providing "studio direct" broadcasting with the audio quality identical to the DVD release, since it would indeed be the same bits that were on a DVD. As a result, the broadcast will air exactly the same bits that were released to the theaters.

Nevertheless, the meta tag disadvantages of "studio direct" for AC-3 is not readily resolved with the technology from previously known developments for broadcasting stereo and Dolby-ProLogic outputs. A problem that has no remedy is that the signal is fragile. Any single bit error causes an error that lasts for 32 milliseconds. However, the invention provides means for automatic measuring and monitoring an AC-3 signal for quality assurance.

BRIEF DESCRIPTION OF DRAWINGS

The present invention will be better understood by reference to the following detailed description of a preferred embodiment when read in conjunction with the accompanying drawing in which like reference characters refer to like parts throughout the views and in which.

FIG. 5 is a flow diagram of portion of the Encoder switching circuit shown in FIG. 4;

FIG. 6 is a diagrammatic view of an apparatus for checking logging and reporting errors in an AC-3 signal adapted for use in the encoder shown in FIG. 4.

BEST MODE FOR CARRYING OUT THE INVENTION

Figures 1, 2:
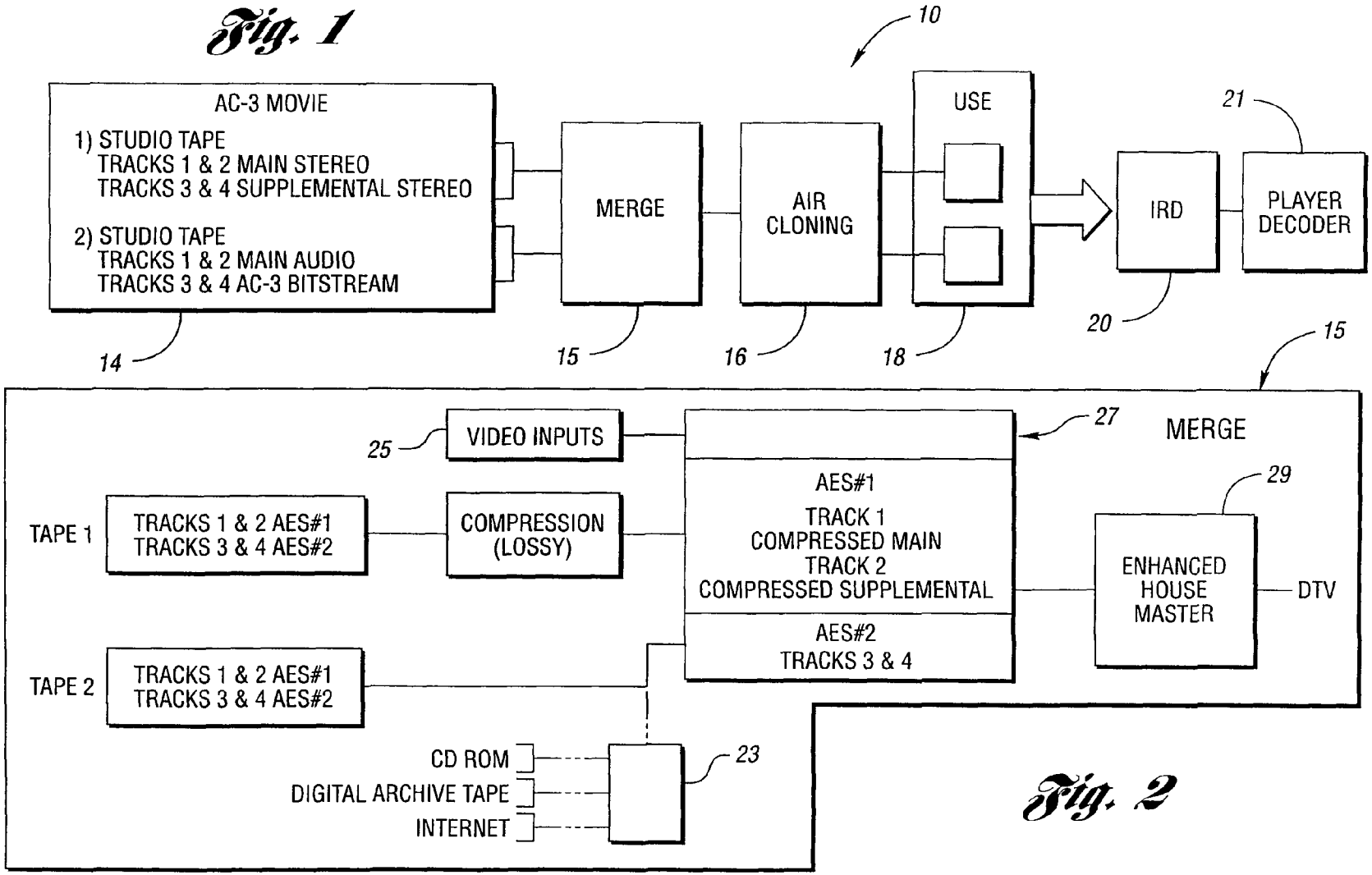
FIG. 1 is a block diagram of a system for preparing and transmitting studio original audiovisual programming with AC-3 standard multiple channel audio output to be ultimately received by the user at an individual receiver decoder device (IRD)
FIG. 2 is a diagrammatic view of the Merge portion of the system shown in FIG. 1.

The present invention overcomes the above mentioned disadvantages by a process to accomplish "studio direct" broadcast of video and television programming recorded with AC-3. The job of the movie studio audio engineer is first described briefly to put the invention in proper context. As inputs, the engineer takes what may be hundreds of tracks of audio and creatively mixes them to generate a plurality of outputs. The inputs can include: none to dozens of audio tracks that were recorded live and in sync with the live film action; none to dozens of audio tracks that were recorded from the musical score; none to dozens of audio tracks of sound effects tracks; or none to dozens of audio tracks from folio sound artists and other "sweetening sounds".

Each of these tracks is mixed down, on a scene by scene basis, to form many products. The first product is a multitrack master. This master contains a mix of all the live action sounds, folio sounds, music and special effects. This master generally contains separate dialog tracks, often times in several different languages. This master generally contains the mix down to multi-channel (typically 6 channel) theatrical release with additional dialog channels. From this master the audio engineer generates a stereo mix down of the audio for normal broadcast release. The audio engineer also tapes the multiple track master with a single language dialog making the final theatrical release. One of the theatrical release formats is Dolby Digital® AC-3, where the audio engineer, through a computer terminal, supplies all the meta data to the Dolby Digital® encoder. Another release format previously known is stereo/Dolby Prologic.

The preferred embodiment of the present invention may be implemented by ordering the studio to provide specific contents on two tapes as follows. One tape contains video and uncompressed stereo English digital data and uncompressed stereo second language audio digital data. This tape is identical to the tape that is normally delivered to broadcasters such as DIRECTV®. The second tape contains video, uncompressed stereo English and compressed Dolby Digital® AC-3. Since these tapes are made on Digital Betacam® machines, the audio is recorded digitally. Data can be supplied and delivered from the machine in AES (Audio Engineering Society) standard AES-3. Each AES-3 signal can carry an uncompressed stereo audio. AES-3 can also carry compressed Dolby Digital AC-3 data. The definition of how AC-3 is placed in an AES-3 is in the Appendix B of the ATSC document A/52 as well as documents IEC958 and IEC1937. This interface is well documented and incorporated herein by reference.

The two tape delivery means used in the preferred embodiment was driven by the proliferation of Sony Digital BetaCam® machines within DIRECTV®, but it is not, however, the only method. Dolby Digital® AC-3 is essentially data and can therefore be delivered by the same means as any data. Going through the process of making yet another tape is time consuming by the studio, in that for a two-hour movie, it takes two hours to make a copy of the AC-3 data to videotape. Traditional data delivery means are not constrained by the notion of "real time" and can accomplish the job much faster. Other applicable means for the present invention include but are not limited to the following examples. A CD-ROM may be loaded to contain the AC-3 data. This costs little, for example, about one dollar U.S., and can be done unless than 15 minutes. A digital computer archive tape may be prepared, such as 8 mm or DLT format. This would increase cost about five times but take less than 10 minutes to generate. A computer network, such as the Internet, could deliver Dolby Digital® AC-3, using TCP/IP protocols and file exchange protocols such as File Transfer Protocol (FTP). Depending on the line speed, this could be accomplished in seconds and does not require any media or transportation costs.

At the start of studio use of AC-3, broadcast devices previously available were not capable of playing Dolby Digital® data in sync with video. A prototype of such a device was developed within DIRECTV® and is described below.

The two tapes specifically requested from the studio arrive by common carrier at DIRECTV® and are processed as follows to make an "airtape". The "airtape" is a tape that is played to broadcast on air and is made in the preferred embodiment as described below.

In the above description, all tape machines are Sony Digital Betacam® machines. The two tapes ordered are sync rolled. The stereo English and stereo second language audio tracks are placed into Tekniche® model 6047T compressor. This box does a lossy audio compression of audio and puts out a proprietary data stream of Tekniche, Inc. that occupies one full AES-3 digital audio stream. The pre-encoded AC-3 is then dubbed to the second AES-3 digital audio track on the Betacam® recorders. Signals are delayed in the dubbing process to assure synchronization between audio and video.

Although the above description explains the method currently in use, DIRECTV® is developing prototype equipment that would functionally replace the Sony Digital BetaCam® with a box that would play the raw "AC3" file as data in sync with video. As shown at 23 in FIG. 2, examples of inputs such as CD-Rom, digital archive tape or an internet site may transfer AC-3 data to a converter 23 for compression and creation of the house master tape to be prepared for cloning and broadcast.

Video input 25 represents at least one of a plurality of components that can be added to the house mastertape 27. Inputs include a countdown clock, interstitials such as edited forms of trailers, rating labels, FBI warnings, "stereo" labels and the like to produce an enhanced house master 29. DIRECTV® produces a "countdown clock" that is edited at the beginning of each tape. This segment is placed ahead of the content, such as a movie from studio, making a tape ready for air play. The "air play" tape then goes through a quality assurance step at DIRECTV® to verify that the tape was made correctly. A technician monitors the tape. With the large multitude of audio tracks, it is difficult for an operator to monitor all audio tracks. To aid the quality control function of the tape, DIRECTV® developed a box that automatically checks the AC-3 stream, logs errors and alarms. This device is also useful for quality assurance during the air play of the movie. This device was deemed beneficial and necessary since AC-3 is a fragile bitstream. This development of apparatus and method is described below.

Referring now to FIG. 2, a simplified block diagram illustrates the system employed at DIRECTV® to prepare for the studio direct "air" tape to actually be played on air. All blocks may function similarly to previously known broadcast mechanisms represented generally by studio output 14, cloning device 16 and the user 18, with the exception of the "Uplink System" that will be detailed below. The cloning 16 is used by the broadcaster for creating a clone tape that runs simultaneously in sync with another "air" tape for simultaneous back-up to preserve broadcast service. The user 18 routes and uplinks the data for broadcast transmission to the integrated receiver decoders (IRD's) 20. Each IRD 20 outputs consumer standard AES-3 signal to a player decoder 21 in a well known manner.

The user 18 of the preferred embodiment uses a Sony Digital BetaCam® that outputs digital video and audio out a SMPTE 259 serial digital interface known as Serial Digital Interface (SDI). The serial signal goes through a router 22 (FIG. 3), for example, a large central facility router 23 through which DIRECTV® sources feed this router, and this router 22 feeds all destinations. The router 22 preferably provides all on air switching, for example, switching between reels of a movie. The router 22 also permits an operator at a station 24 to observe any signal that is within the facility. The Digital BetaCam® AES-3 and timecode outputs can be fed to an automatic AC-3 monitor 26, either in preparation or during on-air use, as described in this disclosure to log and report errors in the AC-3 signal.

Figure 3:
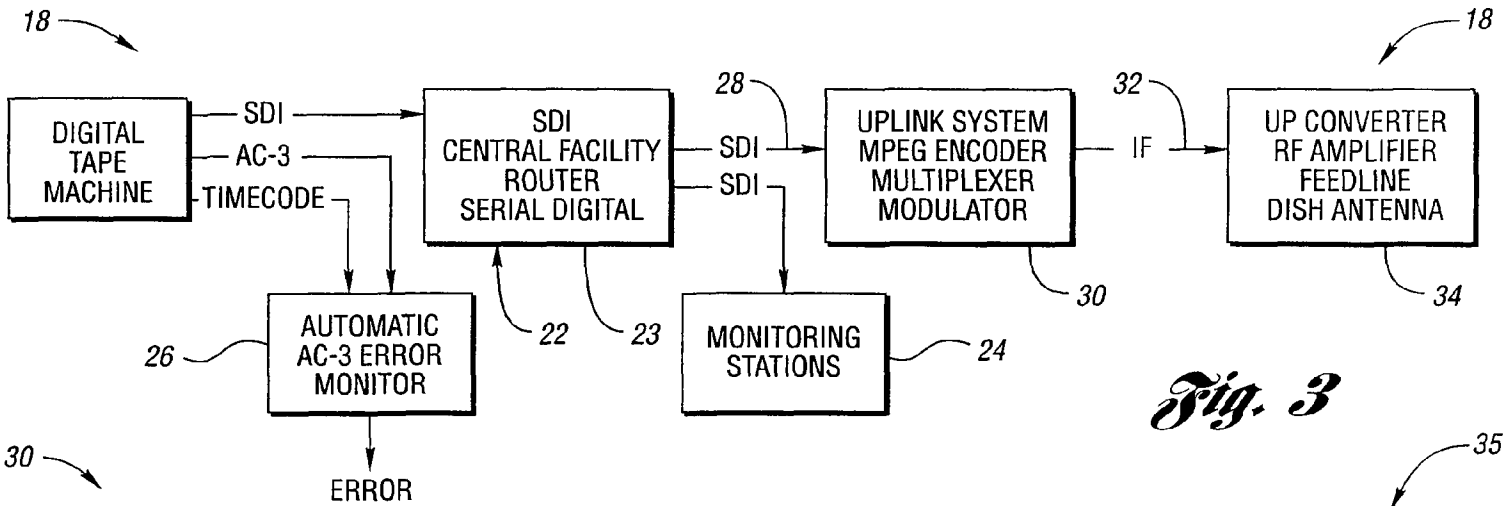
FIG. 3 is a diagrammatic view of the portion of the broadcaster's use segment of the system of FIG. 1.

The program's SDI signal 28 is routed to an Uplink System 30. The Uplink System performs the following operations: video compression using MPEG-2 in real time; decodes the English and second language stereo audio tracks; MPEG layer 1 encodes the English and second language stereo audio tracks; processes the AC-3 data; multiplexes each channel that includes these described tracks with other channels adding in conditional access and program guide information; scrambling; insertion of forward error correction (FEC) information, and modulating the signal to an IF 32 (FIG. 3.). The IF signal is then up converted as shown at 34 to the uplink carrier frequency, amplified and fed to a dish antenna so the signal can be transmitted up to a satellite.

Figure 4:
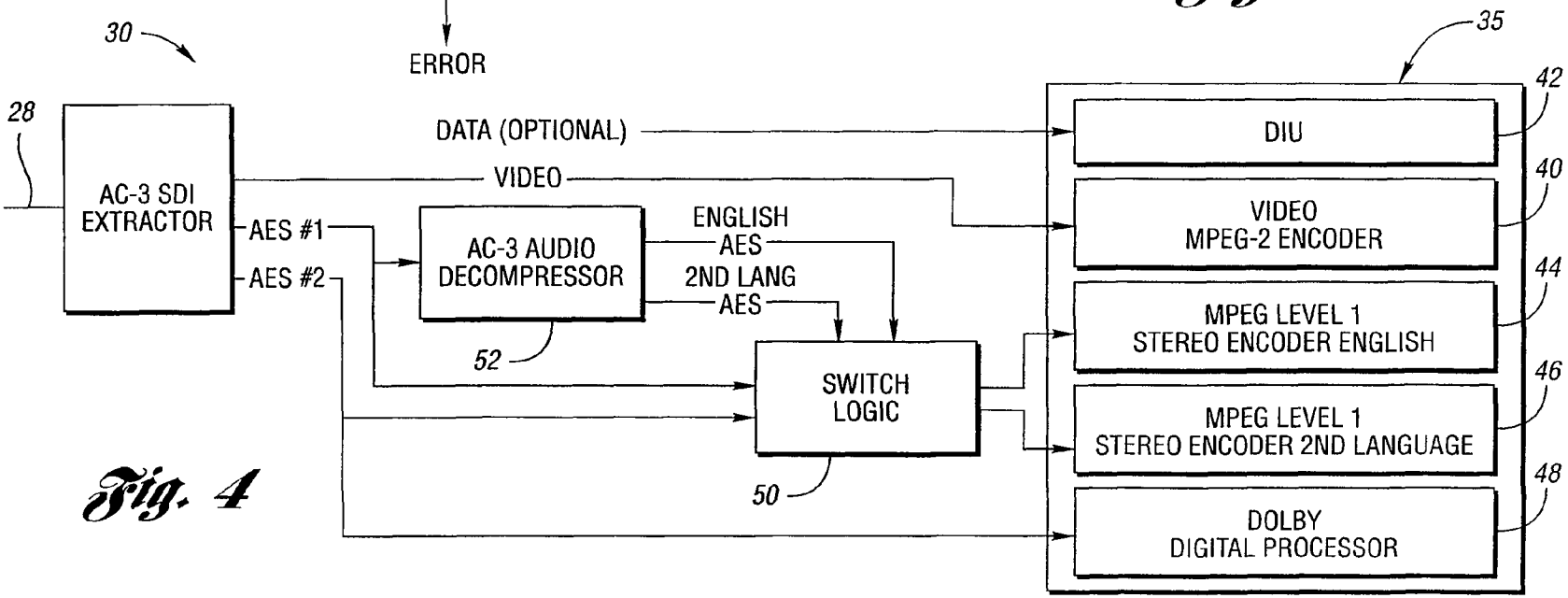
FIG. 4 is a diagrammatic view of an Uplink system portion shown in FIG. 3.

The "Uplink System" 30 shown in FIG. 4 contains an "encoder" 35. The encoder portion 34 of the "Uplink System" is detailed in FIG. 4. Specifically left out of this diagram is the multiplexer, scrambling, the FEC and the modulator, since they are not modified from known attributes that contribute to practice of the present invention. A data interface unit (DIU) 42, a video MPEG-2 encoder 40, an MPEG level 1 stereo encoder 44 for English, an MPEG level 1 stereo encoder 46 for an alternate language, and a Dolby Digital processor 48 are within the encoder 35 of the preferred embodiment. The encoder 35 outputs data in the format of DSS® transport packets. These packets are then scrambled, multiplexed together in the multiplexer, being combined with other channels as well as conditional access information and program guide in the uplink system 30.

The SDI signal 28 from the central facility router 24 feeds an AES-3 SDI extraction device, such as a Tekniche 6026E. This device separates the AES-3 data from the SMPTE 259 serial data stream. The SDI containing video is passed on to the MPEG-2 video encoder 40. The first AES-3 channel extracted is fed two places: to the input of a decompressor 52, preferably a Tekniche 6048T decompressor that readily recognizes the small data packages as AC-3 data or compressed, uncompressed PCM signal, and to the input of switch logic 50. The second AES-3 channel is fed two places: to the input of the switch logic 50 and to the input of a Dolby Digital processor 48.

The function of the "switch logic" 50 is to detect the presence of the compressed Tekniche signal on the first AES (#1) signal, each having two tracks of audio (i.e., L and R stereo PAIR). If the compressed signal is present, then the switch logic takes the decoded audio from the Tekniche 6048T and routes them to the two MPEG Level 1 stereo encoders 44 and 46. If the compressed Tekniche signal is not present on the AES #1 signal, then the source is assumed to be not Dolby Digital® compatible. Consequently, the switch routes AES #1 directly to the MPEG Level 1 Stereo Encoder for English 44, and AES #2 to the MPEG Level 1 Stereo Encode for second language 46. The function of the preferred embodiment of the "switch logic" is described in greater detail with respect to FIG. 5.

As shown in FIG. 4, the AES #2 signal is routed to the Dolby Digital® Processor 48. This DDP 48 takes AES signal as input and can identify if compressed data such as Dolby Digital® signal is present. If present, the processor 48 checks for discontinuities and modifies the signal, time stamps the signal and places the data into DIRECTV® transport packets, for example by arranging CRC values as described below, as specified by DIRECTV® specification DTV95MDB02, "DSS® Transport Protocol Specification for the IRD", a proprietary and confidential document to DIRECTV, Inc., although other standards for transport such as MPEG 2 transport standard or ISO/IEC 13818-1 may be employed. Several unique and novel functions performed in this block are described below.

While this system of equipment and technologies were employed to provide "studio direct" Dolby Digital® signal, other components and systems may be employed without departing from the present invention. Where the exact same data that was generated by the audio production engineer at the studio for theatrical release may be delivered to the home through direct broadcast satellite.

For describing parts of the encoder modifications according to the present invention, a review of ATSC A/52, IEC 959 and IEC 1937 standards is described. Processed signals, such as Dolby Digital signal when sent in serial digital format is sent as packets of data on an AES-3 transport. The AES-3 is a serial transport mechanism that when operated at the industry standard audio sampling rate of 48 Khz can provide for the conveyance of 96,000 32 bit words per second. This provides for two samples, preferably a left and right sample, for each audio sample period of a frequency of 48 KHz. Of these 32 bits, many of them are overhead, conveying framing information, and ancillary information about what is carried as payload. When a Dolby Digital® processor signal is placed in an AES-3, each 32 bit word contains only a 16 bit word of AC-3 data. The data rides in place of the 16 most significant Pulse Code Modulation (PCM) values of audio. All industry-recording devices support recording of at least the minimum of 16 most significant bits of PCM data. As a result, data positions in that location can be recorded by machines traditionally designed for digital audio.

There are three ways in which Dolby Digital® AC-3 data can be arranged in an AES-3 stream: 1) occupying both left and right sample positions, called "32 bit mode" by Dolby Labs; 2) occupying only left sample positions, called "16 bit left" by Dolby Labs, and 3) occupying only the right sample position, called "16 bit right" by Dolby Labs.

In the preferred embodiment, the "32 bit mode" version of AC-3 at 48 Khz sampling is employed. This configuration is compatible with all consumer electronic equipment and is the most common arrangement of AC-3 data within an AES-3. The detailed discussions throughout this application will refer only to this mode. However, the present invention may be employed with the other two modes of mapping of AC-3 data into an AES-3 signal as well as with all the other possible sampling frequencies.

AC-3 data packets are spaced 32 ms, regardless of the mode. In the AES-3 packet can be viewed as a sequence of 16 bit words with an IEC958 header preceding the actual AC-3 data. An AC-3 packet example with an IEC958 header made up of four 16 bit words includes the words Pa, Pb, Pc, Pd, wherein:

Pa=0xF872 (Ox=hexidecimal),

Pb=0x4E1F (Ox=hexidecimal),

Pc="Burst value information" containing a stream identification number assigned typically (if only one type of data is present) of the type of data that follows, and Pd="length code" equal to the number of bits of data that follow.

In addition, two 16 bit WORDS SYNC and CRC1 precede the data words, wherein:

SYNC="AC-3 sync frame"—first byte of AC-3 data, always equal to 0xB77 (Ox=hexidecimal), and CRC1=First Cyclical Redundancy Check (CRC) value in the AC-3 packet.

Each following series of data words precedes a second cyclical redundancy check (CRC2) wherein:

CRC2=Second CRC value in the AC-3 packet after the data, is always a word the last word of the packet.

Between AC-3 packets, the value of data is not defined, however, the inter packet data is generally set to zero. For 48 KHz, "32 bit mode" AC-3, the IEC958 header and the AC-3 sync frame repeats every 3,072 words. (96,000 words per second*0.032 seconds between packets=3,072 words between packet starts).

AC-3 is particularly unfriendly in video environments. The AC-3 packet rate is (1/32 ms) or 31.25 Hz while the video frame rate is either 29.97 Hz for NTSC, or 25 Hz for PAL. Consequently there is no easy relationship between AC-3 frames and video frames.

AC-3 packets within an AES stream can be pictorially represented on a time line as spaced boxes, the start of the first box and the start of the second box being 32 ms from each other. Given this as a data stream, switches from one data stream to another, for example, from the original tape to the simultaneously played clone, or to the next tape in a series as occurs at the central facility router, may interrupt reception. At a minimum, switches must occur at reel changes, as well as at the start and at the end of a movie. The Dolby Digital Processor in the encoder must properly handle switches of incoming data stream to minimize the effect through the rest of the chain.

There are two parameters of the AC-3 signal that can alter what happens at the switch time: 1) the relative phase of the two AC-3 packets, and 2) the time at which the switch occurs.

For the unique case when the two AC-3 packet streams are identically in sync, where AES "A" is the "from stream", and AES "B" is the "to stream" that is being switched to are perfectly synchronized, if the switch occurs during the "extra time" between packets, switching can occur without error. If, however, the switch occurs in the middle of the packet, a problem is that the start data for the packet will be from stream "A" and the ending data will be from stream "B". The arrangement of CRC's at both the start and the end of the packet enables a standard decoder that check the CRC will pick up that there was an error in the packet and mute the receiver for that packet.

Detection of switching is more complex when there is a significant phase different between the AC-3 packets. With two out of phase streams, four possible switch-points will be considered.

Of the four switch points, where SW1=mid packet of stream A to mid packet of stream B, SW2=mid packet of stream A to no packet of stream B, SW3=no packet of stream A to no packet of stream B and SW 4=no packet of stream A to mid packet of stream B, the worst case occurs if a switch occurring from AES "A" to AES "B" at SW3. This switch case is the worst case given the relatively long chain of operations that follow. There are buffers in both the multiplexers in the encoder, and buffers in the demultiplexer in the home receiver each expecting data that is on average a constant data rate. With a switch at SW3, almost immediately following the packet from stream "A", another perfectly valid packet from stream "B" appears. If the encoder were to process both packets, then during the 32 ms surrounding the switch there will be a near doubling of the overall data rate. This may cause major problems. The encoder buffer now has been over filled with data. To the extent there is overhead in the output fixed bit rate in the multiplexer, the encoder multiplexer would then utilize every available transport packet until it catches up with load. In the receiver, for a time period following the switch the receiver sees it is receiving buffer fill with the excess data. The rate at which the data is being removed is not changed. This can create a data overflow. Something must happen. At a point considerably after the switch, audio and video will be out of synchronization, or a buffer will overflow causing a noticeable error. The net effect is much like a train wreck, where the average number of cars that occupy a stretch of track at a given instance is exceeded. The exact results are difficult to predict, but is assured to be undesirable. The problem is made much worse if a series of switches happen in a relatively short period of time.

The solution implemented is a series of simple criteria for processing. Step one is to detect that a switch has occurred in the incoming AC-3 stream. A switch on the input can be created many places either in the router, or further upstream, such as in editing or even in the movie studio. Such a break or switch of the AC-3 may be called a "disruption". Normally, if nothing has been disturbed, the AC-3 packet sequence will repeat at exactly a 32 ms rate. The sequence of Pa, Pb, Pc, Pd, and AC-3 Sync Word repeats exactly every 3072 data words. Pa, Pb and the AC-3 sync word are fixed values and provide a clear indication of a start of a packet.

The first rule is: Never accept a packet before it is time. If an AC-3 packet begins before 3072 data words from the start of the last packet, it should be ignored and not transmitted.

The second rule is: If a disruption is detected, do not accept another AC-3 packet until at least "X" milliseconds after when an AC-3 packet was supposed to have started, or at least (32+"X") milliseconds from the last AC-3 packet start, wherein "X" is the amount of time that a given data rate would, given a specified, for example, 4 K byte, receiver buffer size, will cause a data buffer under run in the receiver. For example, at 384 kbps, which is 48,000 bytes per second (384,000/8 bits per byte), and given a 2 K byte nominal buffer, "X" would be 42 ms (2,000/48000). This length of time without data, should force a well designed receiver to detect that a disruption has occurred and with the resumption of data, again look to the present time stamp (PTS) values of the audio and video to re-establish lip sync.

If the first rule is followed, buffers will not overflow and a "train wreck is avoided". If the second rule is followed lip sync can be maintained. The worst side effect is that audio will dip to silence for a short period of time at a switch. Not a perfect solution, but a very workable solution given switches can be scheduled. Switches between reels, as well as the start and stop of the movies are generally selected at a point of relative silence. If this is the case, a disruption can occur completely undetectable by the listener.

A modification to the second rule that is less restrictive is as follows: If another packet comes within "N" milliseconds, after when an AC-3 packet was supposed to have arrived, then accept it. If it is greater than "N" milliseconds but less than "X" milliseconds, then do not accept it. This more complex rule permits minor slips in audio video synchronization. A couple millisecond slippage of lip sync is not very noticeable so it is not required to force a buffer to underflow in the receiver. This is a good "trick", however, it fails if the frequencies of disruptions are high.

The logic in the Dolby Digital® processor to first find and to determine if a "disruption" has occurred is described below at page 18. The proper handling of switching and disruptions can provide for delivery of a product to the home receiver that appears to be flawless. This algorithm is all that is required and enables AC-3 encoding to be accomplished at a location other than at the encoder. Again, "studio direct" AC-3 is accomplished.

The transmission of Dolby Digital signal is infested with copyright bits. A copyright bit is a flag embedded in the bit stream that relays to receiving device whether it is permitted to record the data. The ultimate purpose is to limit unauthorized copying of digital material and to protect the creator's property rights. It is customary to have a single means for flagging this information. In the preferred embodiment, there are a total of three locations that contains this information: 1) buried within the AC-3 packet; 2) within the MPEG-2 PES header structure; and 3) within the channel status bits of the AES-3 stream.

Items 1 and 2 in the list above are transmitted by DIRECTV®. Item 3 is a signal that must be regenerated by the IRD when it outputs AC-3 to feed to an external AC-3 decoder. DIRECTV® set the requirement that there exists agreement between item 1 and item 2 to assure an unambiguous recreation of item 3 within the IRD. To be able to do "studio direct", the Dolby Digital Processor (DDP) within the encoder must be able to monitor and control the copyright bits passing by in real time.

There may be three logical modes of operation:

INPUT: Where the encoder takes the AC-3 data that is presented to it, parse through the AC-3 packets and determine the state of the copyright bit and then based on that bit, set the copyright bit in the MPEG-2 PES header to match. The encoder generates the MPEG-2 PES header.

Always ON: Where the encoder is instructed either by an operation or an automation system to force copyright protection to this AC-3 audio stream on. Under this case, if the incoming AC-3 data is marketed with the copyright bit set to off, then that bit must be altered. The MPEG-2 PES header is generated with the copyright bit on. The problem here is that changing a bit in the AC-3 stream causes an error in the CRC codes. The CRC values must be recomputed and altered. This is a messy and at times compute intensive operation.

Always OFF: Where the encoder is instructed either by an operator or an automation system to force copyright protection to this AC-3 audio stream off. Under this case, if the incoming AC-3 data is market with the copyright bit set to on, then that bit must be altered. The MPEG-2 PES header is generated with the copyright bit off. The problem here is that changing a bit in the AC-3 stream causes an error in the CRC codes. The CRC values must be recomputed and altered. This is a messy and at times compute intensive operation.

The resolution of problems and the description of methods by which copyright bits can be altered within AC-3 stream is the subject of another disclosure of DIRECTV® by James Michener, entitled: Method for Altering AC-3 Data Streams Using Minimum Computation, and incorporated herein by reference. To provide for "studio direct" AC-3 and properly control the copyright permissions that can be imposed by contract by the studios, this feature is preferred. Not having this feature or an equivalent such as large computation capacity at this IRD, could cause a broadcaster to reject a PPV movie contract being unable to protect the copyrights wishes of the creator.

There are two possible playback tape formats within DIRECTV®. 1) Uncompressed stereo audio on each of the two AES-3 tracks of the Sony Digital BetaCam®, and 2) AES #1 of a Sony Digital BetaCam® comprised of two stereo audio signals, English and second language utilizing lightly compressed audio. AES#2 contains Dolby Digital AC-3. The first is the traditional format for regular programs where AC-3 is not available. The second is a "new" format of AC-3 compatible programming.

The Uplink system 30 has been developed to determine which of the two formats are being delivered and route the appropriate signals accordingly. Within the Uplink System 30 shown in FIG. 4 is a box 50 labeled Switch Logic. That is shown in greater detail in FIG. 5.

The compression system used in the preferred embodiment was designed by Tekniche and is proprietary to Tekniche, although other compression systems may be employed. An attribute that makes the Tekniche compression excellent for this application is the relatively short time for each frame of audio data. The frame size of the data is approximately 8 samples of audio. This is sufficiently short of a period of time whereas there will be no significant alteration of the lip sync between video and audio. The Tekniche decoder already contains a circuit that can recognize their compressed audio frame. This signal was sufficient to act as a control of a switch that selects either: 1) If the signal on AES #1 is uncompressed, then the original BetaCam® audio (AES #1 and AES #2) is fed to the encoder, and 2) if the signal on AES #1 is compressed signal, then the decompressed outputs from the Tekniche's own decoder is selected and fed to the encoder. This feature was built as a custom version of a Tekniche decoder under direction of DIRECTV®.

In the "Uplink System" diagram, AES #2 is always fed to the Dolby Processor. The Dolby Processor can easily identify the presence of Dolby Digital® AC-3 signal on its input by constantly looking for the IEC958 headers (Pa and Pb) as well as the AC-3 sync frame word in the AC-3 packet. This complex sequence of samples would not normally occur in audio and the chance that it would again repeat exactly 32 milliseconds later is astronomical. This process preferably performed as described below. The ability to have an automatic switch that operates based on the presence of a compressed English and second language permits a broadcaster to selectively transmit AC-3 broadcasts with stereo second language broadcasts without changing configurations.

As described earlier, the Dolby Digital® signal is fragile. A single bit error can destroy a full 32-millisecond slice of audio. Videotape machines were designed with recording uncompressed audio not data as their primary function. If there are imperfections in the tape, most tape machines, rather than using more complex self correcting codes, usually employ error concealment. One popular method is to repeat the last good data sample. Regardless of the error concealment method used, these previously known techniques are ineffective with highly compressed Dolby Digital® signals.

Nevertheless, known machines, such as Sony Digital Beta-Cam® machines, are fairly robust with regard to audio data recording. Assuming the tape and the tape machine are in good conditions, the machines have the capability to play audio data flawlessly for long periods of time. The problem is that at some point errors will happen. The common causes of errors are excessive tape wear, dirt collecting on the playback heads, or head track alignment or excessive head wear. Since the Dolby Digital® is the most fragile signal on the tape machines that have no concealment or correction circuitry will permit errors to occur most noticeably with that data.

The Dolby Digital® signal is capable of being monitored by an electronic device. It is far more reliable to use electronic verification than human. If an error occurs, it sounds like a short 32-millisecond dip to silence. In a quiet scene, unless the volume is extremely high, it is difficult to detect quiet from silence. The present invention provides a device to automatically monitor the data in real time, and a preferred hardware configuration is described below.

As shown in FIG. 6, a PC 100 is configured by coupling to a PC BUS 102 for communication with an Digital Audio Sound Card 104, and a SMPTE Timecode Reader 106. An Ethernet Interface 108 is optional if reporting back to a control error tracking mechanism is desired. The Digital Audio Sound Card is essentially an audio multimedia card, for example, a Creative Labs, Inc. Sound Blaster Live, that provides digital audio input and output capabilities. Of course, there are dozens of vendors that makes cards with these capabilities. For example, Digital Audio Labs, Inc. Digital Only Card; AdB International Corp., and Multi!Wav Digital Pro24®. Though while each of these cards has their own quirks, they are all suited for the application, although the AdB is preferred where in sync editing control is desired as discussed below.

The SMPTE Timecode Reader is less abundant in the market. The card used in the preferred embodiment is the Adrienne Electronics Corporation PC-VLTC/RDR card as available at http://www.adrielec.com/. Similar products are made by Horita as http://www.horita.com/timecode.htm. Tape machines keep time information for each frame of video through the use of the SMPTE timecode. This time code is placed on the magnetic tape and is available in two standard output interfaces. Those interfaces are either Linear Time Code (LTC) or Vertical Interval Time Code (VITC. In LTC, time code is modulated on an audio carrier and provided as an audio signal. In VITC, the time code information is encoded and placed on specific lines of the composite video signal during the vertical blanking period before the start of each picture.

These cards operate within an industry standard "IBM PC compatible" computer. These cards also come with hardware device drivers that operate under the Microsoft Windows® operating system. The sound cards support the Microsoft multimedia API standard and have a common interface. The SMPTE timecode readers come with their own drivers and interface software with no well established interface. An Ethernet card may, optionally, be used to transfer data and alarm information to a server and automation system.

The software written for AC-3 error detection in the present invention uses these drivers and interfaces. The sound card reads data into a buffer and sends a message to the Windows® operating system. The error detection software responds to (handles) the message and starts processing the data. The software consists of a state machine that checks the timing validity and AC-3 data, which first finds the AC-3 packets and once "locked", it detects any discontinuities or loss of signal; and the software computes and checks the CRC value of the AC-3 packet found by the state machine. The method to compute the CRC value is disclosed in the ATSC document A/52.

Figure 7:
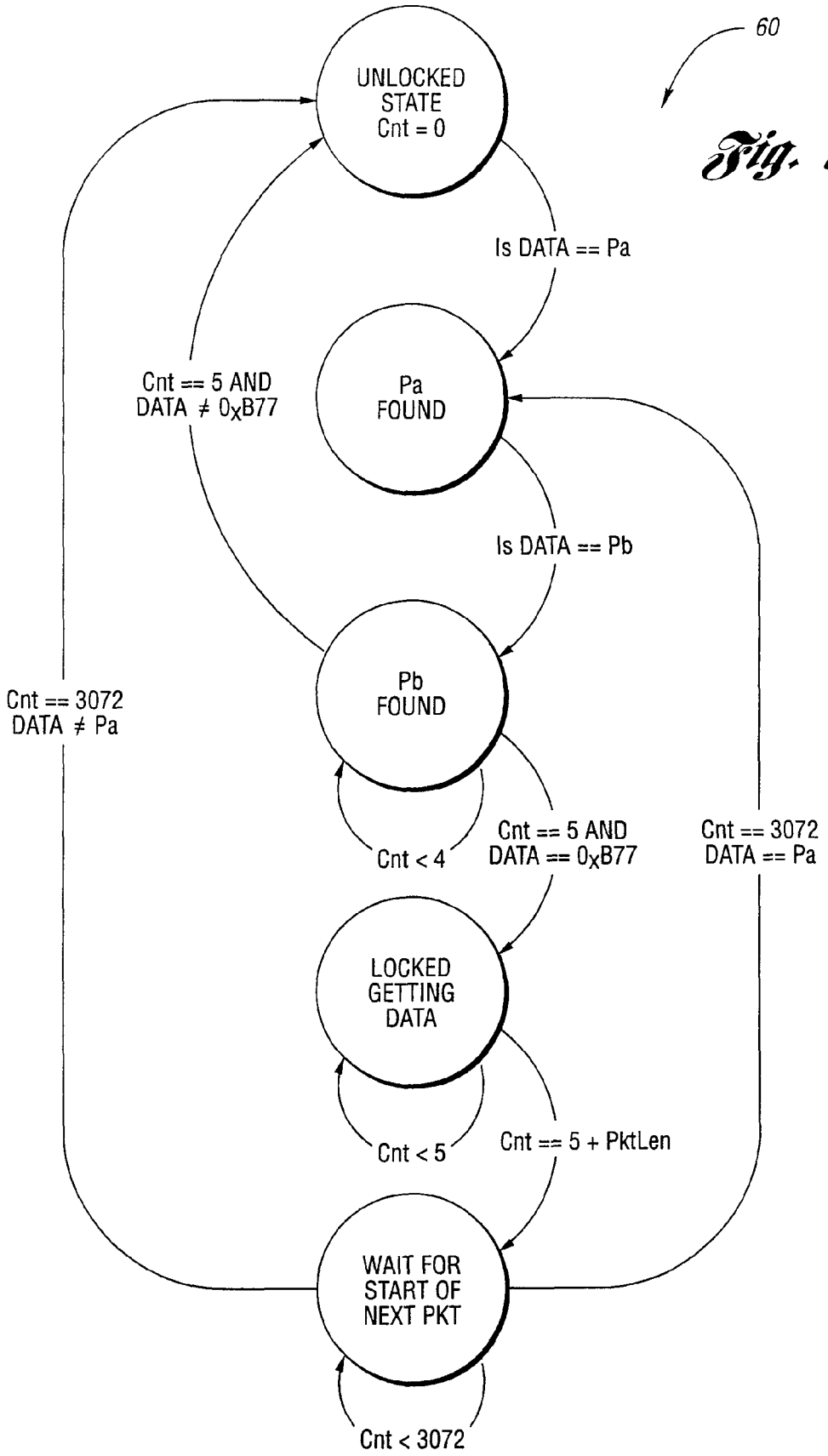
FIG. 7 is a state diagram of a processor control algorithm used in the apparatus of FIG. 6.

The state machine 60 for checking the timing validity of AC-3 data is shown in FIG. 7 as a classic state diagram. Every circle represents a state and the lines show conditions whereby the state of the machine can change. Data comes in from the AES stream and for each new piece of data a decision is made if the state is to change. There is a data counter that increments with each new data word received. The counter is held a zero when unlocked. In the diagram the "Cnt" is a shorthand notation for this data counter.

The state machine is initially in the unlocked state. As each data word is received it checks to see if it is equal to "Pa" or 0xF872 (Ox=hexidecimal). If it is not, it remains in the unlocked state. If it is, the data control Cnt increments and the state advances to "Pa FOUND". The next data word comes in, and if it is found equal to "Pb" or 0x4E1F (Ox=hexidecimal), the data counter Cnt increments and the state machine advances to "Pb Found". Otherwise, the state machine returns to the "Unlocked state". In the "Pb found" state, it stays there until the 5th data sample. If that sample is not 0xB77 (Ox=hexidecimal), representing the first word of an AC-3 packet, or an "AC-3 sync frame word", the state machine goes to unlock. If the fifth data sample is 0xB77 (Ox=hexidecimal), the state advances to the "Locked and getting data" state. Note, that the value of the incoming data at the time when Cnt==3 is captured and remembered. This value is the packet length in bits, so the "PktLen" is determined by dividing that value by 16 (Note: 16 bits to a word). The state machine stays in the locked mode, gathering data of AC-3 and computing CRC values on the data, until the end of the packet. At the precise time, when Cnt==3072, if the data is "Pa" again, indicating another properly spaced packet, the state machine goes back to Pa found. If not, the state machine goes unlocked.

Any transition into the unlocked state from the "Wait and start of next Pkt" state represents a disruption of data has occurred and that there is a timing error on the incoming AC-3 stream. Data received during the "Locked Getting Data" state is fed into a CRC checking program as described in the ATSC document A/52. Any transmission into "Locked Getting Data" for the first time since being in the "Unlocked" state indicates the acquisition of signal of an AC-3 stream. If the state machine stays in the "Unlocked" state for greater than some threshold time, that represents a complete loss of signal. Any of these occurrences represents a significant event, or a change to the incoming AC-3 data stream.

The error condition where the state machine stays in an unlocked state for more than a specified period of time can be caused by one of two reasons. One is a failure of the AC-3 playback track. The second is that the tape machine is no longer rolling. The software can differentiate between these two conditions by the observation of the SMPTE. If after 40 milliseconds the timecode does not advance, it can be assumed that the tape machine is no longer playing.

If a significant event in the incoming stream occurs, it will be detected. The software then goes to the VITC/LTC time code reader and reads the SMPTE time code generated by the tape machine and logs that timecode. Similarly, the software reads the real time clock within the PC and obtains the date and the time of day and logs that as well. If the error conditions are severe enough, alarms related to the conditions occurring can be triggered provoking an immediate operator response or activating automation intervention, for example, automating system intervention central control so that if an error, or too many errors occur, the operator switches to back-up tape machines.

The software receives the AC-3 data from the buffer handed to it by the Microsoft multimedia API and must complete the processing of the data before an error is detected. A significant time lapse may have occurred. To provide a more accurate time estimate of when the error occurs, the average latency time is subtracted off all reported values to obtain the time when error occurred for reporting purposes. This value is roughly equal to one half the record time of the multimedia-input buffer. For example, in a 16 K byte buffer, the time works out to 41 milliseconds or about one frame of video.

If the function being performed is a quality assurance check of a newly generated air tape, the log provides a complete list of the known. Some of the errors are caused through the editing, for example, as at such points as the switch between the trailers and the actual start of the movie. The quality assurance operator is in general the same individual who made the master tape. That operator knows at what timecode these disruptions occurred. If errors occur at time codes that should be contiguous, the tape is known to have errors. The quality assurance operator has the option to wind the tape to the frame of the tape at that timecode and monitor the exact flaw and make a determination of the severity of the problem. The log of errors from a quality check of a tape can then be placed in a database and used as a list of all known and expected errors. When a tape is then played to air, this database is used to filter "known" errors that occur at "air-time". New errors give a clear unequivocal indication that the tape is worn or that the tape machine is in need of preventative maintenance.

The states machine of the type described may be applicable to or similar to techniques present in other Dolby Digital® products. However, the present invention provides the use of this state machine in combination with a real time clock and SMPTE timecode readers to provide automatic means of checking the playback quality of Dolby Digital® both on air and in the tape prep areas of a broadcast facility. No manufacturer has previously provided this feature in any form of equipment despite great utility. Such a device provides an electronic means of quality assurance, to assure that "Studio Direct" Dolby Digital® is done without loss of information. Being electronic, it can be done without human labor at a lower cost.

As described earlier, DIRECTV® currently receives AC-3 data as a separate videotape where one AES-3 track contains the AC-3 data. The generation of this tape is costly and time consuming. The exchange medium for the AC-3 data to the DVD mastering house is a data file. The data file is a binary file that contains AC-3 packets in order, one following the next with no extra space between them and without any IEC958 headers. This file format is from Dolby Labs® and has become the defacto standard. Lip sync is implied in that the first frame of the movie matches with the start of data in the audio file.

No previously known device can play an AC-3 data file and generate an AES-3 signal suitable for building a videotape that contains this track. In addition, no previously known device can start playback of an AC-3 data file at the command of an editor. Although a Sonic Foundry released a version of their software Sound Forge that provides the capability to play an AC-3 data file, the product does not support editor control. Sonic Foundry only partially answered the question providing no means to sync the audio playback with the video. The solution according to the present invention is quite simple. A PC can be built identical to the unit described above for monitoring AC-3 signals. The major difference being that of all the audio cards listed, only the AdB card can operate for this application. The AdB card provides a separate input for a house reference AES clock. This ability permits the AES clock of the playback signal to be locked in frequency to a video production house's master generator, assuring that the frequency of video and audio samples are identical. This assures that lip sync will not drift over time. For this operation, the timecode reader card is optional. The software can, if desired, monitor the time code coming from a tape machine that is playing video and at a pre-determined timecode value begin the playback AC-3 data. An alternative means to start the playback is to start under editor control. The simplest means to accomplish this is by a contact closure performed by the editor and using that to trigger the start of playback. The easiest means of getting a contact closure into a PC is through the game pad, or joystick interface that is widely available on all audio multimedia cards. The Microsoft Windows® API supports this joy-stick interface. The program then simply monitors a specific "fire button" on the joystick to initiate the start of AC-3 playback.

Dolby Labs defined format AC-3 for computer disc may be converted to AES-3 format. The processor looks into the start of the packet and determines the size of the packet. With the size of the packet known the processor generates an IEC958 header. The IEC958 header and the AC-3 packet is then placed in a buffer that is 3072 words long. The extra bits are filled with zeros.

By playing the data out the AES-3 interface card as if it were PCM audio, the conversion is completed.

The present invention includes the system of components that provide the functionality that permits the playback of AC-3 as a data file in sync with video for the generation of a video tape. This reduces the cost of receiving the Dolby Digital® track from the studios and provides a large number of delivery means available, including CDROM, FTP protocol over TCP/IP networks such as the Internet. Such delivery means are faster than the generation of a videotape. In addition, delivery of a data file is better than via tape for movies that are longer than a single reel of tape since in these situations there will occur a disruption of the AC-3 stream at the video tape reel change.

These features of this device are even more useful as related to playback from a video server. Current video servers attempt to mimic a videotape machine, recording both video and uncompressed audio. It would be highly advantageous for these servers to only store the AC-3 data as a data file, as compared to it's "AES-3 equal". The size of the file is at least a nearly a third the size, it reduces the transfer time as well as problems with discontinuities.

Since previously known tape machines providing recording of only two AES-3 streams, adding Dolby Digital® from a single machine if a dual language capability is required creates some compromise decisions to be made.

The obvious solution is to use the first AES-3 track to carry stereo English language. The second AES-3 track could then contain a second language monaural on one channel, for example, for left channel, and AC-3 could be placed in "16 bit mode" on the other, for example, right channel. Such a process raises two difficulties. First, the second language customers now only have monaural service. Second, AC-3 is recorded in a mode that is not supported by consumer electronic monitors. This format for AC-3 in an AES-3 signal is unusual.

The preferred embodiment of the present invention uses a light level of compression and places two channels of stereo audio into the first AES-3 track. The preferred system also places AC-3 in the common "32 bit" mode on the second AES-3 track. This provides the capability of maintaining stereo broadcast services for both the primary English and second language broadcasts. Until these, to date it appears that no other broadcasters have followed the path of DIRECTV® and have expressed concern over the downgrading of the second language.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for automatically checking cataloging and reporting errors in an AC-3 bit stream signal carried as a sequence of AC-3 data packets that repeat at a fixed spacing on a real-time AES-3 signal stored with a video signal and a time code for each frame of video on a recording media, said video and AES-3 signal providing a synchronized audio/video signal, comprising:

an audio sound card that converts the AES-3 signal to computer readable language and stores the data in a computer memory;

a time code reader that reads the time code for each frame of the video signal from the recording media, and a processor operative while preparing the recording media for broadcast, said processor processing the AC-3 data packets from the data in the computer memory to detect discontinuities in the AC-3 data packets from the fixed spacing as timing errors, reading the time code from the time code reader to assign a time stamp to the timing error and recording the timing error and time stamp in a log.

2. The apparatus of claim 1, further comprising:

a real time clock that provides the date and time of day, wherein said processor reads the real time clock to assign the time stamp to the timing error, whereby the time stamp includes both the date and time of day and the time code.

3. The apparatus of claim 1, wherein the recording media comprises a tape.

4. The apparatus of claim 1, wherein the processor comprises a state machine that finds AC-3 data packets, locks into each packet, and detects any discontinuities in the presentation of the AC-3 data packets on the AES-3 signal from the fixed spacing as timing errors.

5. The apparatus of claim 1, wherein the computer memory comprises a buffer.

6. An apparatus for automatically checking cataloging and reporting errors in an AC-3 bit stream signal carried as a sequence of AC-3 data packets that repeat at a fixed spacing on a real-time AES-3 signal, wherein data comes in from the AES-3 signal as a stream of data words and the fixed spacing between AC-3 data packets is defined by a specified number of data words, comprising:

an audio sound card that converts the AES-3 signal to computer readable language and stores the data in a computer memory; and a processor comprising a state machine that finds AC-3 data packets, locks onto each AC-3 data packet and detects any discontinuities in the presentation of the AC-3 data packets on the AES-3 signal from the fixed spacing as timing errors by counting the number of data words to the next data packet and detecting a timing error if the counted number of data words is different than the specified number of data words, assigns a time stamp to the timing error and records the timing error and time stamp in a log.

7. The apparatus of claim 5, wherein the processor computes and checks a CRC value of the AC-3 packet found by the state machine, assigns a time stamp to any CRC error and records the CRC error and time stamp in the log.

8. The apparatus of claim 5, wherein the computer memory comprises a buffer.

9. An apparatus for automatically checking cataloging and reporting errors in an AC-3 bit stream signal carried as a sequence of AC-3 data packets that repeat at a fixed spacing on a real-time AES-3 signal stored with a video signal on a recording media, comprising:

an audio sound card that converts the AES-3 signal to computer readable language and stores the data in a computer memory;

a time code reader configured to read a time code for each frame of the video signal from the recording media if the time code is provided on the recording media;

a real time clock that provides the date and time of day; and a processor that processes the AC-3 data packets from the data in the computer memory to detect discontinuities in the AC-3 data packets from the fixed spacing as timing errors and to compute and check a CRC value of each said AC-3 data packet to detect CRC errors, reads the real time clock to assign a first time stamp to the timing or CRC error, if available reads the time code to provide a second time stamp and records the timing or CRC error and one or more time stamps in a log.

10. The apparatus of claim 9, wherein the processor comprises a state machine that finds AC-3 data packets, locks into each packet, and detects any discontinuities in the presentation of the AC-3 data packets on the AES-3 signal from the fixed spacing as timing errors and wherein the processor computes and checks the CRC value of the AC-3 packet found by the state machine to detect CRC errors.

11. The apparatus of claim 9 wherein data comes in from the AES-3 signal as a stream of data words and the fixed spacing between AC-3 data packets is defined by a specified number of data words, said state machine locks onto each AC-3 data packets and counts the number of data words to the next data packet detecting a timing error if the counted number of data words is different than the specified number of data words.

* * * * *